US007391980B2

(12) United States Patent
Sekiguchi et al.

(10) Patent No.: US 7,391,980 B2
(45) Date of Patent: Jun. 24, 2008

(54) IMAGE FORMING APPARATUS INCLUDES A FIXATION DEVICE CONTROL BASED ON A SHEET-TYPE WHEN A JAM OCCURS

(75) Inventors: Nobuo Sekiguchi, Moriya (JP); Akihito Mori, Toride (JP); Takashi Nagaya, Moriya (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 455 days.

(21) Appl. No.: 11/114,166

(22) Filed: Apr. 26, 2005

(65) Prior Publication Data

US 2005/0249511 A1 Nov. 10, 2005

(30) Foreign Application Priority Data

Apr. 28, 2004 (JP) ..... 2004-132960

(51) Int. Cl.
*G03G 15/00* (2006.01)

(52) U.S. Cl. ..... 399/20; 399/21; 399/389; 399/400; 399/122; 399/322

(58) Field of Classification Search ..... 399/20, 399/21, 389, 400, 122, 322, 397
See application file for complete search history.

(56) References Cited

U.S. PATENT DOCUMENTS 4,392,739 A * 7/1983 Brown et al. ..... 399/332
4,796,035 A 1/1989 Kawasaki et al. ..... 346/108
5,075,732 A * 12/1991 Menjo ..... 399/45
5,290,024 A 3/1994 Takahashi ..... 271/122
5,474,287 A 12/1995 Takahashi ..... 271/10.13
5,502,545 A * 3/1996 Tsuruoka ..... 399/21
5,666,595 A 9/1997 Sameshima et al. ..... 399/110
5,815,788 A * 9/1998 In't Zandt ..... 399/400
5,909,872 A 6/1999 Takahashi ..... 271/116
5,988,628 A 11/1999 Mori ..... 271/117
5,991,563 A * 11/1999 Haneda et al. ..... 399/68
6,059,285 A 5/2000 Suga et al. ..... 271/228
6,253,046 B1 * 6/2001 Horrall et al. ..... 399/124
6,311,039 B1 10/2001 Funamizu et al. ..... 399/394
6,347,196 B1 * 2/2002 Kawabata et al. ..... 399/16
6,393,232 B1 5/2002 Osari et al. ..... 399/82
6,397,035 B2 5/2002 Kataoka et al. ..... 399/388
6,570,667 B1 * 5/2003 Hattori et al. ..... 358/1.15
6,793,425 B2 9/2004 Yoshikawa et al. ..... 400/624
7,050,751 B2 5/2006 Watanabe et al. ..... 399/391

(Continued)

FOREIGN PATENT DOCUMENTS

JP 61-6675 1/1986

(Continued)

*Primary Examiner*—Ren Yan
*Assistant Examiner*—Matthew G Marini
(74) *Attorney, Agent, or Firm*—Fitzpatrick, Cella, Harper & Scinto

(57) ABSTRACT

An image forming apparatus of the present invention includes an image formation portion for forming a toner image on a sheet, and a fixation device for fixing the toner image formed by the image formation portion on the sheet. When a sheet jam occurs, it is controlled whether the fixation device should be driven such that the sheet is discharged from the fixation device based on a sheet type.

7 Claims, 10 Drawing Sheets

U.S. PATENT DOCUMENTS

| | | | | |
|---|---|---|---|---|
| 7,058,329 | B2 | 6/2006 | Takahashi | 399/69 |
| 2004/0247333 | A1 | 12/2004 | Takahashi | 399/68 |
| 2005/0082737 | A1 | 4/2005 | Sasaki et al. | 271/9.12 |
| 2005/0220466 | A1 | 10/2005 | Takahashi et al. | 399/45 |
| 2005/0220467 | A1 | 10/2005 | Takahashi et al. | 399/45 |
| 2005/0249511 | A1 | 11/2005 | Sekiguchi et al. | 399/20 |
| 2006/0018678 | A1 | 1/2006 | Sekiguchi et al. | 399/70 |
| 2006/0024072 | A1 | 2/2006 | Kuroki et al. | 399/33 |
| 2006/0083528 | A1 | 4/2006 | Mori et al. | 399/67 |

FOREIGN PATENT DOCUMENTS

| | | | |
|---|---|---|---|
| JP | 7-181828 | | 7/1995 |
| JP | 07181828 | A * | 7/1995 |
| JP | 11-24506 | | 1/1999 |
| JP | 2001-154527 | | 6/2001 |
| JP | 3-282373 | | 3/2002 |
| JP | 2002-278356 | | 9/2002 |

* cited by examiner (a)

(b)

(a)

(b)

IMAGE FORMING APPARATUS INCLUDES A FIXATION DEVICE CONTROL BASED ON A SHEET-TYPE WHEN A JAM OCCURS

BACKGROUND OF THE INVENTION

The present invention relates to an image forming apparatus such as a copying machine, a facsimile machine and a printer which fuses an unfused image formed on a sheet while sandwiching and conveying the unfused image using a fixation unit.

FIELD OF THE INVENTION

In a conventionally proposed image forming apparatus, a fixation unit which fuses an unfused toner image formed on a sheet such as a sheet of paper comprises a heating roller and a pressure roller, or a heating roller and a pressure belt which are opposed to each other as one pair. In the image forming apparatus having such a fixation unit, if there exists a sheet of paper in the fixation unit when a paper jam occurs downstream of the fixation unit, the paper is forcibly discharged from the fixation unit (Japanese Patent Application Laid-open No.2001-154527).

According to this technique, toner is fused on the sheet of paper when the paper in the fixation unit is forcibly conveyed. Thus, when a user clears the paper jam after paper is forcibly discharged, it is possible to avoid a case in which toner adheres to the heating roller and toner makes the paper dirty.

However, in recent years, it is required to use thick paper having high rigidity of paper of 200 g/m$^2$ or more also in the image forming apparatus. In this case, if the thick paper is forcibly conveyed from the fixation unit, there is a possibility that the fixation unit itself is damaged. That is, if the thick paper existing in the fixation unit is forcibly conveyed when a paper jam occurs, the roller of the fixation unit and the thick paper come into slide contact due to the rigidity of the thick paper, and there is a possibility that the roller surface is damaged.

SUMMARY OF THE INVENTION

It is an object of the present invention to enhance the jam clearance operation of a user, and to minimize a damage of the fixation unit.

To achieve the above object, the present invention provides an image forming apparatus comprising:

an image formation portion for forming a toner image on a sheet;

a fixation device for fixing, on the sheet, the toner image formed by the image formation portion; and a controller which controls whether the fixation device should be driven such as to discharge the sheet from the fixation device depending upon a sheet type of the sheet when a jam of the sheet occurs.

DETAILED DESCRIPTION OF THE EMBODIMENTS

Preferred embodiments of the present invention will be exemplarily explained in detail with reference to the drawings. However, sizes, materials, shapes and relative layout of constituent members described in the following embodiments are appropriately changed depending upon a structure and various conditions of the apparatus to which the present invention is applied, and the invention is not limited to the described ranges only unless the ranges are specifically described.

[Image Forming System]

Figure 1:
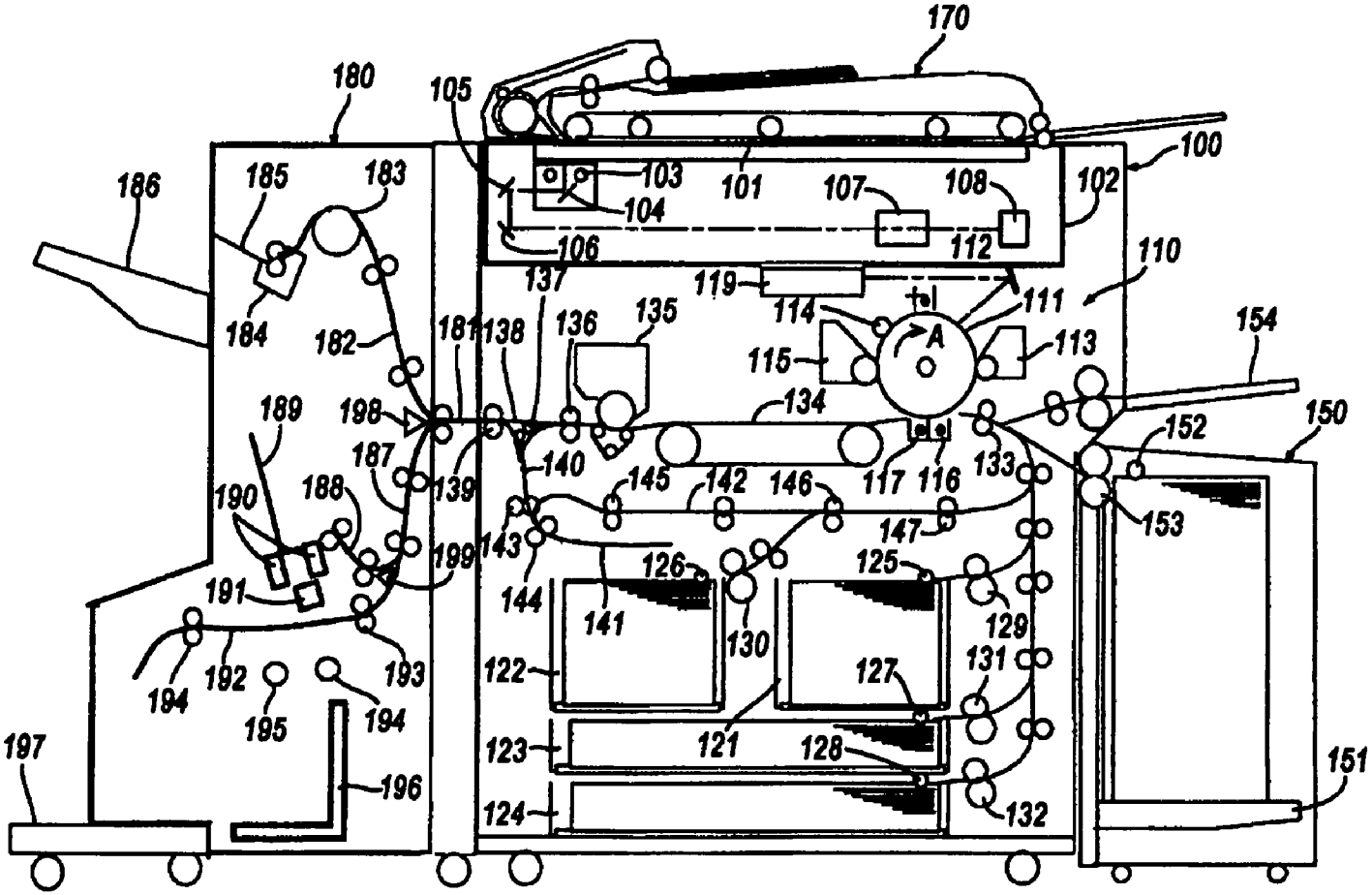
FIG. 1 is a sectional view of an image forming apparatus having a sheet processing apparatus according to an embodiment of the present invention.

In the following embodiments, an image forming system having an image forming apparatus body and a sheet processing apparatus will be explained as an image forming apparatus. FIG. 1 is a schematic sectional view of the image forming system having the image forming apparatus body and the sheet processing apparatus according to an embodiment of the invention.

[Image Forming Apparatus]

In FIG. 1, a reference symbol 100 represents an image forming apparatus body, a reference symbol 170 represents an automatic original feeder, a reference symbol 101 represents a platen glass as an original mount. A reference symbol 102 represents a scanner as image reading means, and the scanner 102 comprises an original illumination lamp 103 and a scanning mirror 104. The scanner 102 reciprocates and scans in a predetermined direction by a driving motor (not shown). During the reciprocating and scanning operation, light reflected from the original passes through a lens 107 through scanning mirrors 104 to 106, and forms an image of the original on a CCD sensor in an image sensor 108.

A reference symbol 109 represents an exposure controller comprising a laser and a polygon scanner. The exposure controller 109 irradiates a photosensitive drum 111 of an image formation portion 110 with leaser beam which is converted into an electric signal by the image sensor 108 and modulated based on an image signal which is subjected to a predetermined image processing. In the image formation portion 110 as the image forming means, a primary charger 112, a development unit 113, a transfer charger 116, a separation charger 117, a front exposure lamp 114, a cleaner 115 and the like are disposed around the photosensitive drum 111. The photosensitive drum 111 rotates in the direction of the arrow A by the driving motor (not shown). After the photosensitive drum 111 is charged with predetermined potential by the primary charger 112, the photosensitive drum 111 is radiated with leaser beam from the exposure controller 109. With this, an electrostatic latent image is formed on the photosensitive drum 111. If toner from the development unit 113 is allowed to adhere to the electrostatic latent image, the developed toner image is obtained.

Sheets such as recording paper which are fed by pickup rollers 125, 126, 127, 128 from a first feeding cassette deck 121, a second feeding cassette deck 122, an upper feeding cassette 123 or a lower feeding cassette 124 are conveyed toward the image formation portion 110 by feeding rollers 129, 130, 131, 132 one sheet by one sheet. The sheet conveyed in the vicinity of the image formation portion 110 is fed to the image formation portion 110 by a registration roller 133. If the sheet comes into contact with the photosensitive drum 111 on the image formation portion 110, a toner image on the photosensitive drum 111 is transferred by a transfer charger 116. Toner remaining on the photosensitive drum 111 after the transfer is cleaned by a cleaner 115. Then, residue electric charge of the photosensitive drum 111 is erased by the front exposure lamp 114.

The sheet after the transfer is separated from the photosensitive drum 111 by a separation charger 117. The sheet separated from the photosensitive drum 111 is conveyed to a fixation unit 135 which is a fixation device by a transfer belt 134. A toner image transferred to the sheet is pressurized and heated by the fixation unit 135 and fused on the sheet. Then, the sheet is discharged outside of the image forming apparatus body 100 by a discharge roller 136.

The image forming apparatus body 100 is provided with a deck 150 capable of accommodating a large amount of sheets (e.g., 4,000 sheets). A lifter 151 of the deck 150 rises in accordance with the amount of sheets so that the sheets always abut against a pickup roller 152. The uppermost sheet is sent to the image forming apparatus body 100 by the feeding roller 153 one sheet by one sheet. The apparatus also includes a multi-manual feeding tray 154 capable of accommodating sheets of any size.

In FIG. 1, a reference symbol 137 represents a switching flapper. The switching flapper 137 switches the feeding direction of the sheet between a discharging path 138 and a reverse path 140. When images are formed on both sides of a sheet (both-sided recording, or both-sided copy), a sheet sent from the discharge roller 136 is introduced toward the reverse path 140 by switching the switching flapper 137. The sheet introduced into the reverse path 140 once enters a lower conveyance path 141 by a reverse roller 143 and a both-sided reverse roller 144 and then, the moving direction of the sheet is reversed by the both-sided reverse roller 144 and is conveyed to the re-feeding path 142. With this, the sheet is turned over and introduced to the re-feeding path 142. A sheet fed from the second feeding cassette deck 122 to the feeding roller 130 is also introduced to the re-feeding path 142. Reference symbols 145, 146 and 147 represent re-feeding rollers. They again feed a sheet introduced to the re-feeding path 142 to the image formation portion 110.

A reference symbol 139 represents a discharge roller. The discharge roller 139 is disposed in the vicinity of the switching flapper 137. The discharge roller 139 discharges a sheet whose moving direction is switched to the discharge roller 139 by the switching flapper 137, outside of the image forming apparatus body 100.

When a sheet is reversed from the image forming apparatus body 100 and discharged out, the sheet is introduced to the reverse path 140 by the switching operation of the switching flapper 137, and the sheet is pulled into the lower conveyance path 141 to a position where a rear end of the sheet remains in the reverse path 140 by the reverse roller 143. Then, the reverse roller 143 is reversely rotated to turn back the sheet and the sheet is sent toward the discharge roller 139, and the sheet is discharged out from the image forming apparatus body 100 by the discharge roller 139.

[Sheet Processing Apparatus]

A reference symbol 180 represents a sheet processing apparatus which carries out case binding processing and staple processing. A sheet sent out from the discharge roller 139 passes through a body discharging path 181, and is introduced to an upper vertical conveyance path 182 or a lower vertical conveyance path 187 by a processing apparatus flapper 198. When the sheet is introduced to the upper vertical conveyance path 182, the sheet is discharged to a processing tray 185 where a staple unit 184 and an alignment unit (not shown) are disposed. When a sheet discharged to the processing tray 185 is stapled by the staple unit 184, since the sheet can not be discharged to the processing tray 185, the sheet is wound around a buffer roller 183, and is brought into a standby state before being discharged. If the staple operation is completed at the processing tray 185, the sheet is discharged toward the discharge tray 186.

When a sheet is introduced to the lower vertical conveyance path 187 by the processing apparatus flapper 198, the sheet is introduced to a main body discharging path 188 or a front cover discharging path 192 by a binding flapper 199. When the sheet is introduced to the main body discharging path 188, the sheet is discharged to the main body processing tray 189. Sheets loaded on the main body processing tray 189 are sandwiched by a main body crimping portion 190, and one side of the main body which is a batch of sheets are bonded by a bonding portion 191. When sheets are introduced to the front cover discharging path 192 by the binding flapper 199, they are handled as front covers, and they are conveyed and stopped such that central portions of the sheets which are front covers come into tight contact with one sides of the sheets which are main body bonded by the main body processing tray 189. The processing tray 189 is lowered, the main body is brought into tight contact with the front cover, and they are sandwiched by the binding discharge rollers 194 and 195, and if they are tightly contacted, they are sandwiched and discharged to the cutting portion 196. Although it is not described in detail, sides of the front cover and main body other than the bonding portion can be cut off in the cutting portion 196. After the cutting processing is carried out by the cutting portion 196, the sheets are discharged to the binding discharge tray 197.

[Control System]

Figure 2:
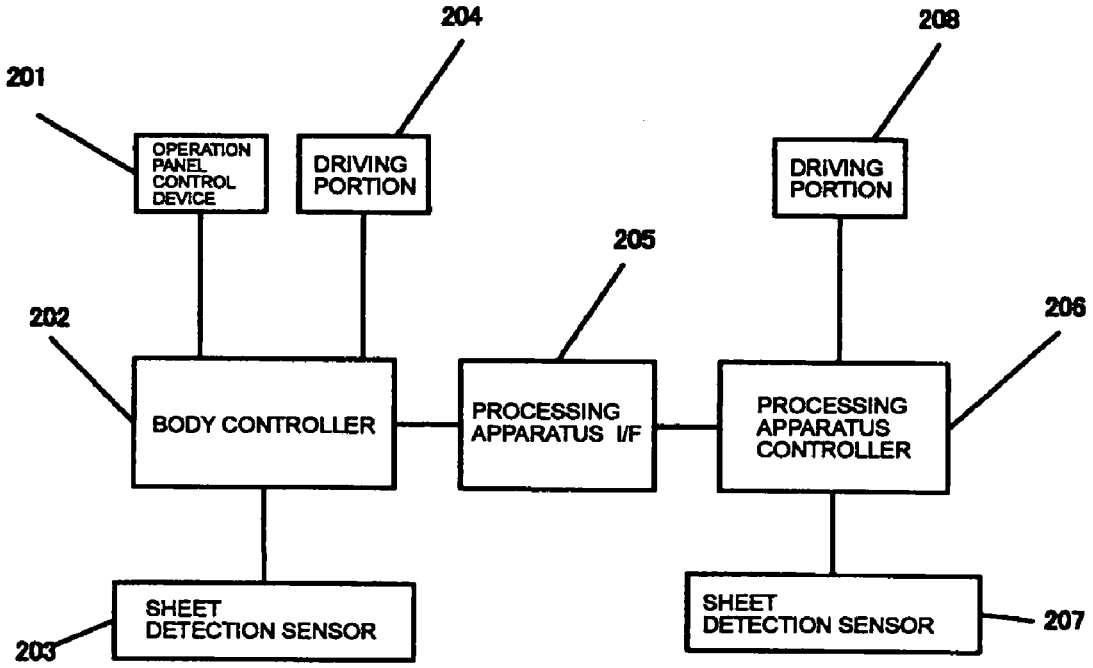
FIG. 2 is a control block diagram of a control system for controlling the image forming apparatus of the embodiment of the invention.

FIG. 2 is a control block diagram of a control system which controls the image forming apparatus body 100. In FIG. 2, a reference symbol 201 represents a operation panel control device. The operation panel control device 201 controls input from an operation panel 300 which will be described later using FIG. 3, and LCD display and sound.

A reference symbol 202 represents a body controller. The body controller 202 controls the entire operation of the image forming apparatus body 100. The body controller 202 comprises a ROM and a RAM in which programs are incorporated. The programs are for carrying out various operations of the image forming apparatus body 100. The operations are that sheets are selectively fed from the deck, the cassette, and the tray one sheet by one sheet, a toner image is formed by the image formation portion, the image is transferred on the sheet, and the image is fixed on the sheet by the fixation unit.

A reference symbol 203 represents a sheet detection sensor. The sheet detection sensor 203 is disposed on each convey path of the sheet, and the sensor detects whether there a sheet on the convey path. In this embodiment, the sheet detection sensors are appropriately disposed on the convey paths as will be described using FIG. 5, and a detection signal of the sensor is sent to a body controller 202 through the sheet detection sensor 203.

A reference symbol 204 represents a driving portion. The roller, the belt, the flapper and the like which constitute the image forming apparatus are controlled by the body controller 202 through the driving portion 204. The driving operation of the fixation unit 135 is also controlled by the body controller 202 through the driving portion 204.

A reference symbol 205 represents a processing apparatus I/F. The processing apparatus I/F 205 is used when sheet is sent and received between the image forming apparatus body 100 and a sheet processing apparatus 180, the information concerning whether there is a sheet in the discharge tray 186 is displayed on the operation panel 300 (see FIG. 3), and the body controller 202 is informed of control or state of the sheet processing apparatus from the processing apparatus controller 206.

The reference symbol 206 represents the processing apparatus controller. The processing apparatus controller 206 controls the entire operation of the sheet processing apparatus 180, conveys a sheet received from the image forming apparatus body 100, carries out processing such as the staple operation, and informs the body controller 202 of the state of the discharge tray 186. The processing apparatus controller 206 controls driving instructions and stop such that the processing apparatus controller 206 obtains information concerning whether there is a sheet on the convey path in the sheet processing apparatus from the sheet detection sensor 207 of the sheet processing apparatus 180, the processing apparatus controller 206 conveys a sheet to the driving portion 208 of the sheet processing apparatus 180 or a sheet is subjected to a predetermined processing.

[Operation Panel]

Figure 3:
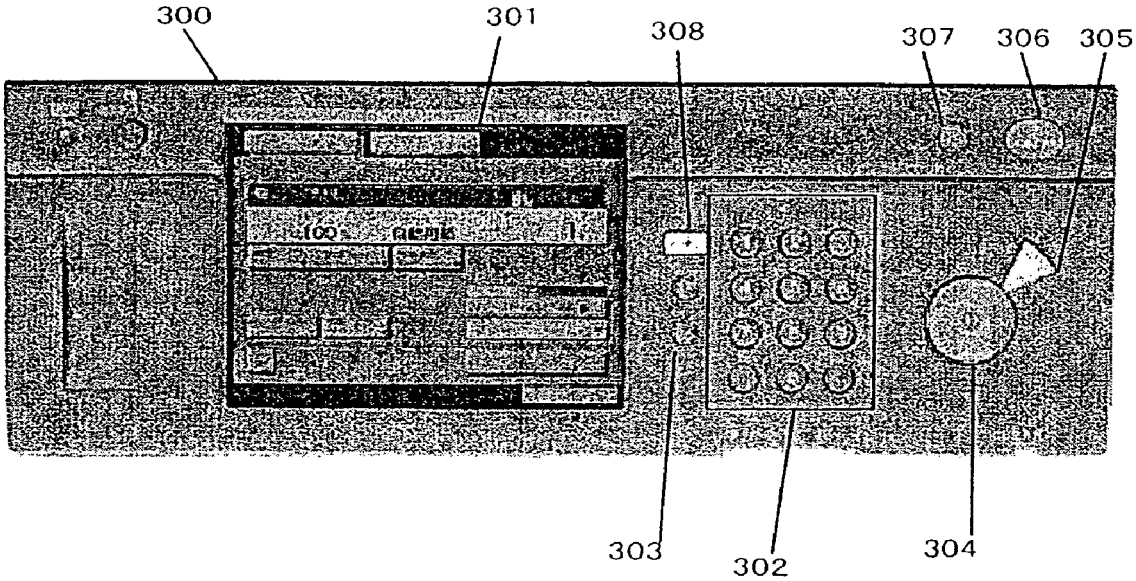
FIG. 3 are explanatory views of an operation panel used for operating the image forming apparatus of the embodiment of the invention.
Figure 3:
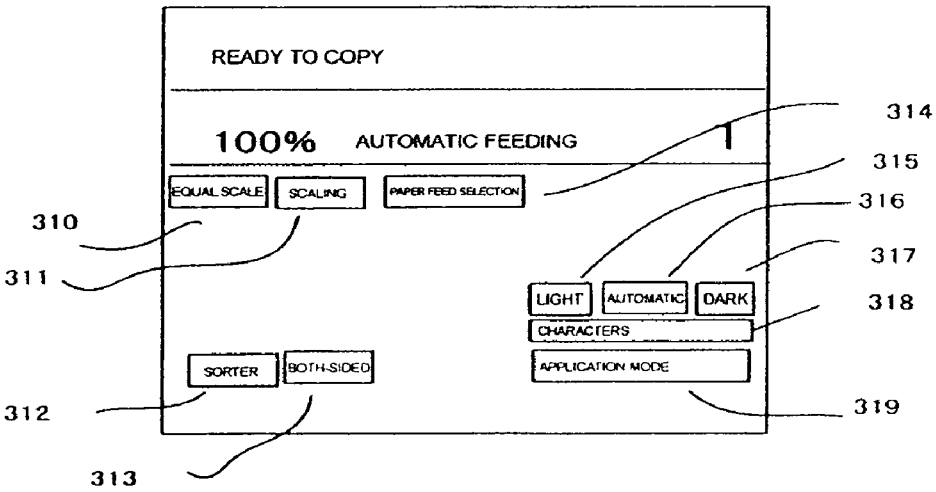

FIG. 3 are explanatory views showing one example of the operation panel through which the image forming apparatus shown in FIG. 1 is operated. FIG. 3(*a*) shows the operation panel 300 which is a portion of the image forming apparatus body. In the operation panel 300, a reference symbol 301 represents the LCD display portion 301. As shown in FIG. 3(*b*), a screen for setting various operation functions of the image forming apparatus is displayed on the LCD display portion 301. A reference symbol 302 represents a numeric keypad 302 for inputting numeric values 0 to 9. A reference symbol 303 represents a user mode key, and the key is used for changing the setting in accordance with a user's preferences such as various operation modes of the image forming apparatus. This will be described later using FIG. 4. In this embodiment, when a type of sheets is to be registered, the user mode key 303 is pressed, and a type of sheet to be used is set.

A reference symbol 308 represents a reset key. The reset key 308 is used for returning a function which was changed in setting by the LCD display portion 301 or numeric (the number of sheets to be copied) set by the numeric keypad 302 to a default value. A reference symbol 304 represents a start key used for starting the execution operation in accordance with a function set by the LCD display portion 301. A reference symbol 305 represents a stop key used for stopping the operation carried out by the image forming apparatus. A reference symbol 306 represents a power key through which the power supply of the image forming apparatus body 100, the automatic original feeder 170 and the sheet processing apparatus 180 is turned ON or OFF. A reference symbol 307 represents a power saving mode key used for setting various standby electricity such as the temperature of the fixation unit 135 and electricity of the motor at the time of standby mode in which the operation of the image forming apparatus is stopped.

FIG. 3(*b*) is a schematic explanatory view showing the LCD display portion 301 of the operation panel 300 as described above. A reference symbol 310 represents an equal scale setting key, a reference symbol 311 represents a changing scale key for changing scale, and the scale which is set here is reflected to the control of the scanner 102 as the image reading means of the image forming apparatus body 100. A reference symbol 312 represents a sorter key through which various processing modes of sheets to be processed by the sheet processing apparatus 180 can be set. A reference symbol 313 is a both-sided mode setting key through which it is set whether both sides are to be printed, whether only one side of the original fed by the automatic original feeder 170 is to be read, and whether both sides are to be read. A reference symbol 314 is a paper feed selection key used for selecting a paper feeding stage of the body paper feeding stages (121 to 124, 150 and 154). A reference symbol 316 is an automatic image conversion mode setting key through which a character mode, and a backing ignoring mode in which reading operation of a backing of an original is automatically skipped are set. Reference symbols 315 and 317 are image concentration setting keys for increasing or reducing the image reading concentration in the image reading mode set through the image mode key 318. A reference symbol 319 is an application mode key used for setting various copying modes which can be edited by other image forming apparatuses.

[Sheet Determining Means]

Figure 4:
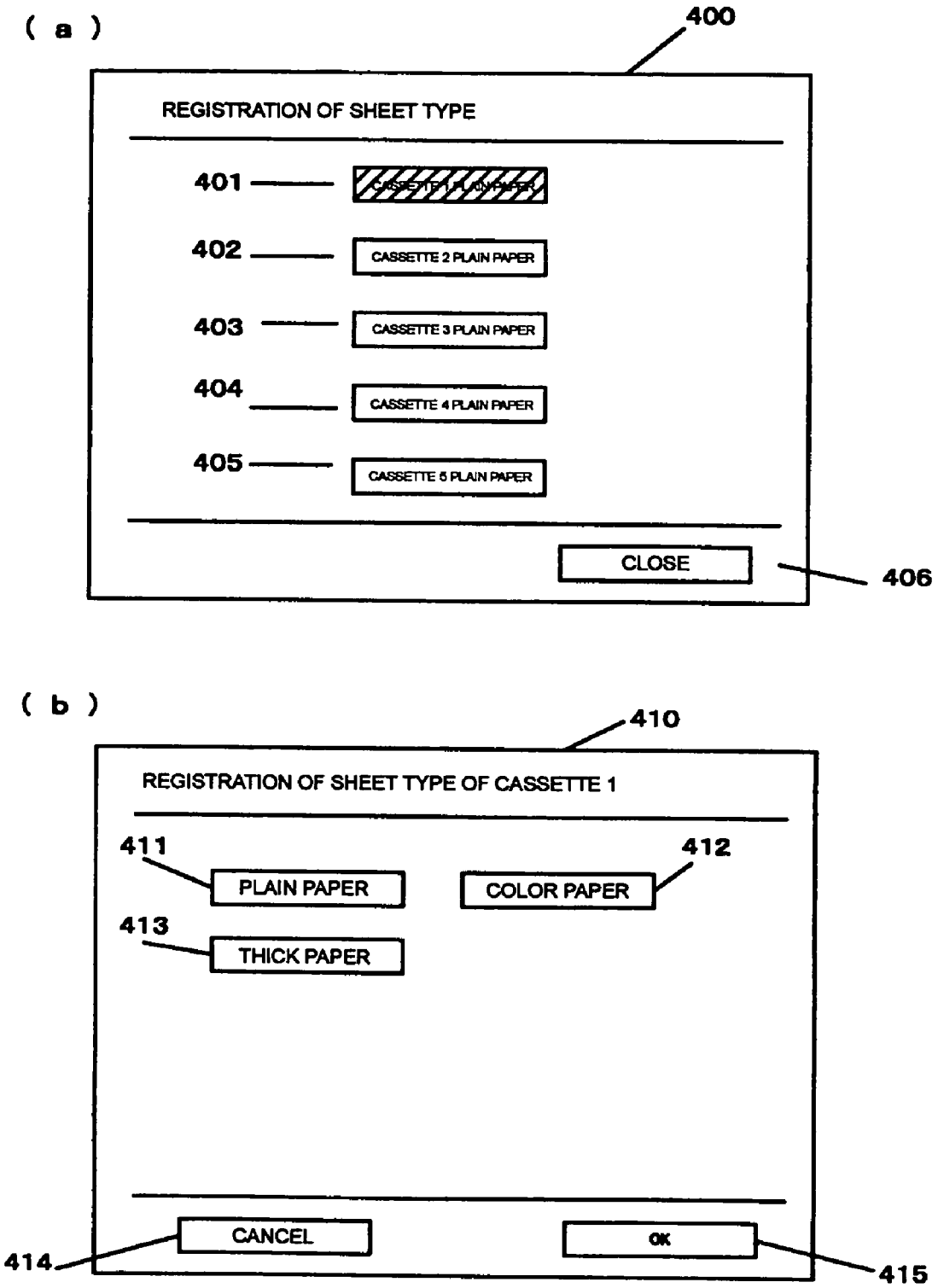
FIG. 4 are explanatory views showing an example of a screen on which a sheet type is set using the image forming apparatus of the embodiment of the invention.

Next, sheet detection means which distinguishes types of sheets will be explained. In this embodiment, sheet type setting means in which a sheet type is previously registered is shown as the sheet detection means. FIG. 4 are explanatory views showing one example of screens for setting the sheet type by the image forming apparatus according to the embodiment of the invention. FIG. 4 show the screens for setting sheet types of the cassettes and decks by the LCD display portion 301 of the operation panel 300.

FIG. 4(*a*) shows a sheet type setting screen 400 for each of the cassettes and decks. The sheet type setting screen 400 is displayed when the user mode key 303 (see FIG. 3(*a*)) is pressed and a registration key of the sheet type is pressed by a user mode selection screen. Feeding cassette decks 121 and 122 and feeding cassettes 123, 124 and a deck 150 of the image forming apparatus body 100 are displayed as cassettes 1 to 5 of selection keys 401 to 405. When a sheet type of the first feeding cassette deck 121 is to be set for example, the selection key 401 (cassette 1) corresponding to this is pressed, the selection key 401 is inverted into black as shown in FIG. 4(*a*), and the operation is transited to a main screen 410 shown in FIG. 4(*b*) where the sheet type is to be set. Similarly, when the sheet type of the feeding cassette deck 122 is to be set, the selection key 402 (cassette 2) corresponding to this is pressed. When the sheet type of the upper feeding cassette 123 is to be set, the selection key 403 (cassette 3) corresponding to this is pressed. When the sheet type of the lower feeding cassette 124 is to be set, the selection key 404 (cassette 4) corresponding to this is pressed. When the sheet type of the option deck 150 is to be set, the selection key 405 (cassette 5) corresponding to this is pressed. When nothing is set, "plain paper" is selected as default value as shown in FIG. 4(*a*). A reference symbol 406 is a key used for closing the screen, and this key is used when the main setting screen 400 is to be closed and the procedure is to be returned to the user mode selection screen.

The main screen 410 through which the sheet type is set shown in FIG. 4(*b*) shows an example of display when the cassette 1 is selected. A reference symbol 411 represents a plain paper key. If a sheet on the first feeding cassette deck 121 is plain paper, the key 411 is pressed. Since the plain paper is selected as a default value, if a user opens this main screen 410 for the first time, the plain paper is selected (inverted into black). A reference symbol 412 represents a color paper key, and if a sheet on the first feeding cassette deck 121 is plain paper, this key is pressed. As data (sheet type) required when the body controller 202 distinguishes the sheet type, since the color paper is handled in the same manner as that of the plain paper, the display icon of the sheet type of the paper feeding stage shown in FIG. 4(*a*) is merely changed. A reference symbol 413 represents a thick paper key, and if a sheet on the first feeding cassette deck 121 is thick paper, this key is pressed. The sheet type information which is previously registered here is used as information of sheet type at the time of the jam clearance operation which will be described later. A reference symbol 414 represents a cancel key, a reference symbol 415 represents an OK key, and they are keys for returning to the setting screen 400 while saving the condition selected in the main screen 410 or without saving the condition.

In this example, the plain paper, the color paper handled in the same manner as that of plain paper, the thick paper having stronger rigidity of paper than the plain paper (thicker paper than plain paper) are shown as sheet types, but the invention is not limited to this. The information concerning the sheet types required in the embodiment is roughly divided into two types, i.e., a sheet which is forcibly discharged as will be described later, and a sheet which is not forcibly discharged. Since the sheets which are merely roughly divided into two types are classified into a plurality of names, the names and the number of keys of the sheet types displayed in the main screen 410 may appropriately be set for each of apparatuses in accordance requirements. The term "sheet type" used here includes the thickness of the sheet, or the strength of rigidity of paper, i.e., the rigidity of sheet.

[Example of Convey Path of Image Forming Apparatus Body]

Figure 5:
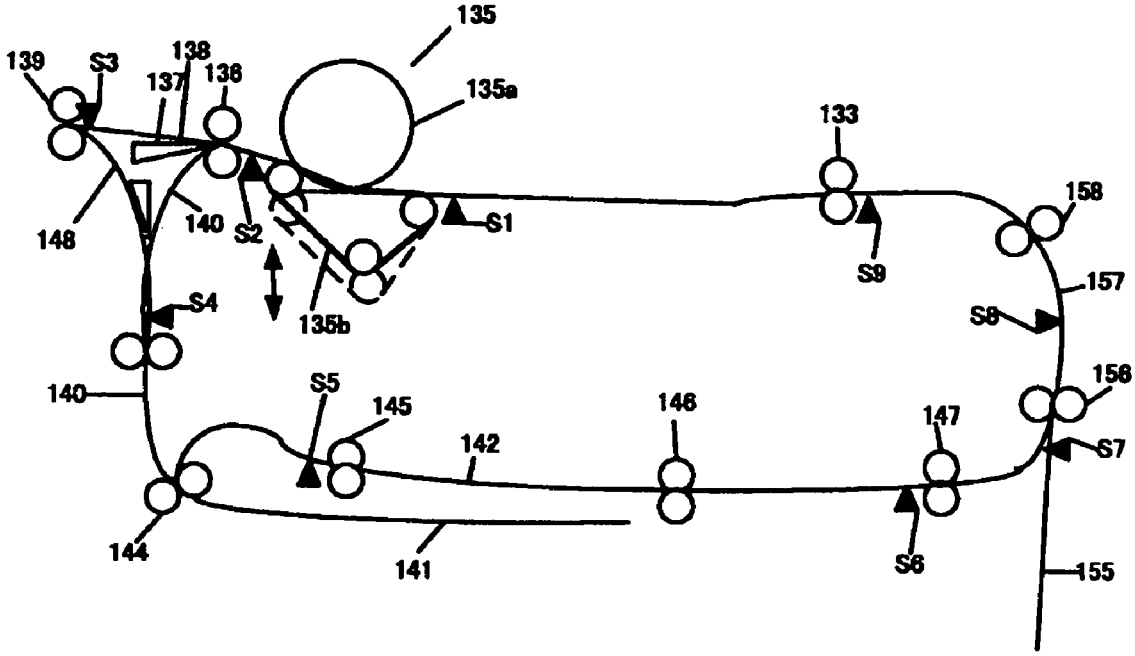
FIG. 5 is a schematic explanatory view showing a sheet conveyance path of an image forming apparatus body of the embodiment of the invention.

FIG. 5 shows a convey path of a sheet from which cassettes and decks of the image forming apparatus body 100 and the image forming portion are eliminated. A reference symbol 135 represents a fixation unit of the image forming apparatus body 100. The fixation unit 135 includes a pair of rotating bodies comprising a heating roller 135*a* and a crimping belt 135*b* which can abut against and separate from each other. The belt fixation unit 135 sandwiches a sheet on which a toner image is formed by the image formation portion and heat-fixes the unfused toner image on the sheet. The crimping belt 135*b* can abut against and separate from the heating roller 135*a*. The crimping belt 135*b* and the heating roller 135*a* are separated from each other by a separating mechanism such as solenoid. The crimping belt 135*b* and the heating roller 135*a* are operated by controlling the separating mechanism by means of the body controller 202. When a sheet is not conveyed or when the image forming apparatus body 100 is not operated, the crimping belt 135*b* moves in the direction of the arrow and can separate from the heating roller 135*a*.

A reference symbol S1 represents a pre-fixing sensor as sheet detection means which detects jam of a sheet to the fixation unit. The pre-fixing sensor S1 is disposed upstream in the vicinity of the fixation unit 135, and detects whether there is a sheet on a convey path of the sheet upstream in the vicinity of the fixation unit 135. A reference symbol S2 represents a post-fixing sensor as sheet detection means which detects jam of a sheet. The post-fixing sensor S2 is disposed downstream in the vicinity of the fixation unit 135 and detects whether there is a sheet on a convey path of the sheet downstream in the vicinity of the fixation unit 135. In the above-described control system (see FIG. 2), based on the sheet detection sensors S1 and S2 disposed upstream and downstream of the fixation unit 135 and information of the sheet detection means explained using FIG. 4, it is determined whether the crimping belt 135*b* of the fixation unit 135 should immediately be separated from the heating roller 135*a* or a sheet existing in the fixation unit should forcibly conveyed toward the downstream and then the crimping belt 135*b* is separated from the heating roller 135*a* when a sheet jam occurs.

The apparatus includes the switching flapper 137 which switches a sheet from the fixation unit 135 to the discharging path 138 or the reverse path 140. An outer discharge sensor S3 detects whether there is a sheet introduced from the fixation unit 135 to the discharging path 138 by the switching flapper 137, and the sheet is discharged out from the apparatus by the discharge roller 139. A reverse sensor S4 provided on the reverse path 140 detects whether there is a sheet introduced from the fixation unit 135 to the reverse path 140 by the switching flapper 137. When the sheet is reversed and discharged out from the apparatus, if a rear end of the sheet reaches the reverse sensor S4, the reverse roller 143 is reversely rotated to send the sheet to the reverse discharging path 148. In the case of the both-sided mode, a sheet introduced to the reverse path 140 is sent into the lower conveyance path 141 until its rear end reaches the both-sided reverse roller 144, the both-sided reverse roller 144 is reversely rotated, and the sheet is reversely conveyed toward the re-feeding path 142. The sheet sent to the re-feeding path 142 is detected by a first re-feeding sensor S5, a first re-feeding roller 145 and a second re-feeding roller 146 are driven, and the sheet is conveyed in the re-feeding path 142. Further, the sheet is detected by a second re-feeding sensor S6, and the sheet is conveyed toward the image formation portion to print an image on its back surface by a third re-feeding roller 147.

When the image can not be formed by the image formation portion, the apparatus is brought into the standby state in which a sheet tip end exists in the re-feeding roller 147. This standby position of the sheet is a position where the sheet tip end passes by a given distance from the re-feeding sensor S6, and this position is a re-feeding starting position where an image is formed on the sheet back surface. Further, in the case of the both-sided mode, a sheet fed from the cassette decks 121 and 122 or cassettes 123 and 124 of the image forming apparatus body 100 passes through a feeding path 155, and waits until the sheet is again conveyed by the pre-merging sensor S7 while counting the timing with respect to the sheet from the re-feeding starting position. A sheet located at the re-feeding starting position or the position of the pre-merging sensor S7 is sent out to a vertical convey path 157 by a merging roller 156, and is detected by a vertical conveyance sensor S8 and conveyed by a vertical path roller 158. A pre-registration sensor S9 determines whether the sheet reaches a stopping registration roller 133. If the sheet reaches the registration roller 133, the registration roller 133 is driven in timing of transferring a toner image formed on the photosensitive drum 111 of the image formation portion 110 shown in FIG. 1 by the transfer charger 116 on the sheet, and the conveyance is started to transfer the toner image on the sheet. After the toner image is transferred, the sheet is again conveyed to the fixation unit 135.

[Processing when a Paper Jam Occurs in Other than the Fixation Unit]

Figure 6:
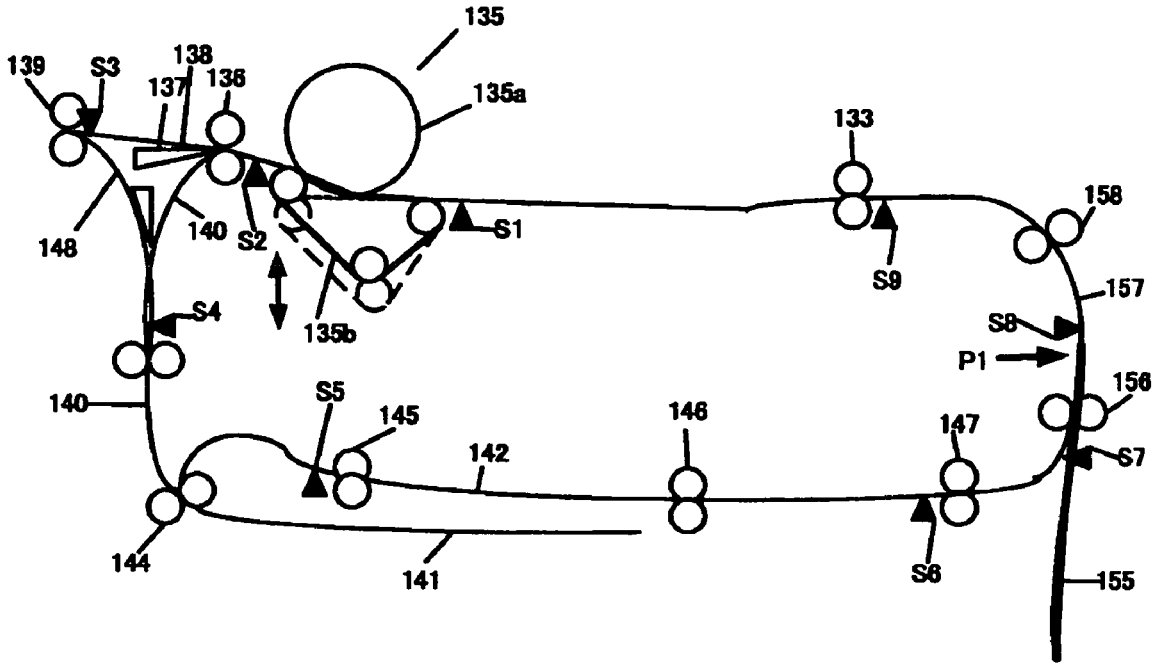
FIG. 6 is an explanatory view showing one example when a paper jam occurs in the image forming apparatus body of the embodiment of the invention.

The processing when a paper jam occurs in a convey path of a sheet will be explained below. FIG. 6 shows a sheet conveyance path of the image forming apparatus body 100 which is similar to that shown in FIG. 5, and shows a case in which a sheet jam occurs at a position P1 in the vicinity of the merging roller 156. In this case, since it is determined that there is no sheet in the sheet detection sensors S1 and S2 near the fixation unit 135, the crimping belt 135*b* of the fixation unit 135 can immediately be separated from the heating roller 135*a*.

[Processing when a Paper Jam Occurs in the Vicinity of the Fixation Unit]

Figure 7:
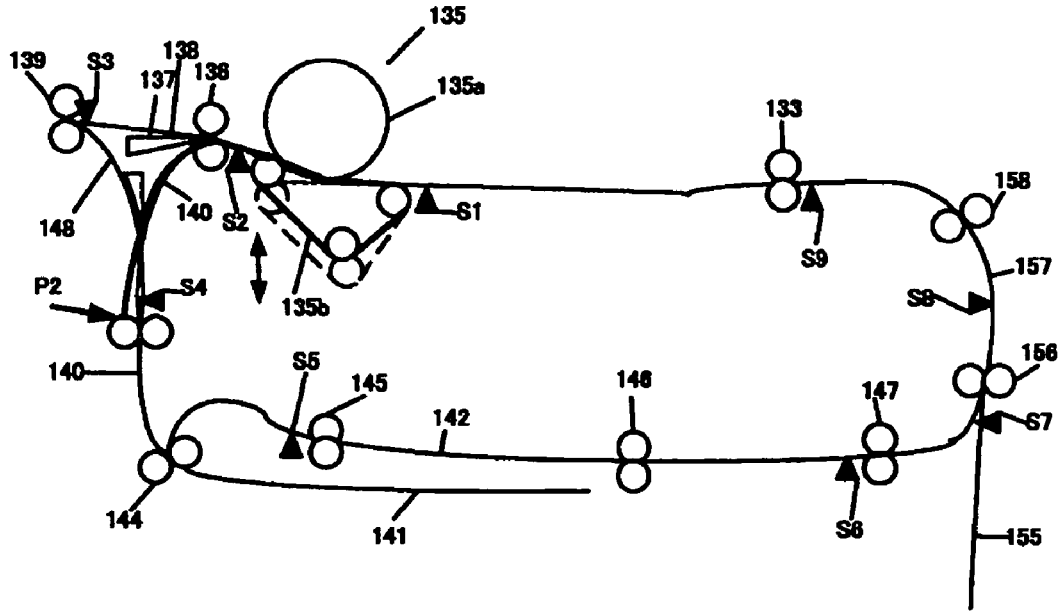
FIG. 7 are explanatory views showing one example when a paper jam occurs in the image forming apparatus body of the embodiment of the invention.
Figure 7:
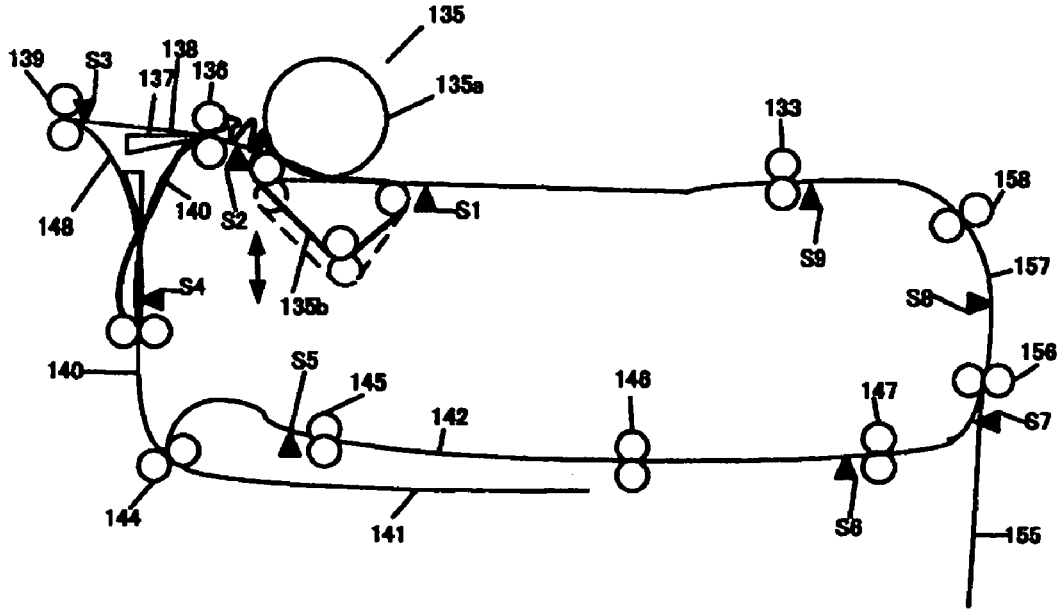

FIG. 7 show a sheet conveyance path of the image forming apparatus body 100 which is similar to that shown in FIG. 5, and show a case in which a sheet jam occurs at a position P2 in the vicinity of the reverse sensor S4 on the reverse path 140. In this case, as shown in FIG. 7(*a*), there is no sheet in the pre-fixing sensor S1, and there is a sheet in the post-fixing sensor S2. That is, since it can be found that there is a sheet in the fixation unit 135, in a state in which the crimping belt 135*b* abuts against the heating roller 135*a*, unfused toner image is completely fused on the sheet, and the sheet is conveyed such that the sheet is forcibly discharged from the fixation unit 135 by the crimping belt 135*b* and the heating roller 135*a* until a rear end of the sheet passes through a nip portion with which the crimping belt 135*b* and the heating roller 135*a* are in contact. FIG. 7(*b*) shows this state. By forcibly sending out the sheet, the toner image can completely be fused on the sheet, this prevents unfused image, and this can enhance the jam processing (jam clearance operation) of a user.

However, when the sheet is relatively thick (thick paper) as explained in FIG. 4, since the thick paper has high rigidity, if the sheet is forcibly conveyed, the thick paper and the heating roller 135*a* on the side of the image to be fused on the thick paper slide against each other, and there is a possibility that a surface of the heating roller 135*a* is damaged. Thus, in this embodiment, the sheet is stopped in the state shown in FIG. 7(*a*) in accordance with the sheet type, and it is determined whether the crimping belt 135*b* should be separated from the heating roller 135*a* immediately or the sheet is forcibly conveyed as in the state shown in FIG. 7(*b*).

Figure 8:
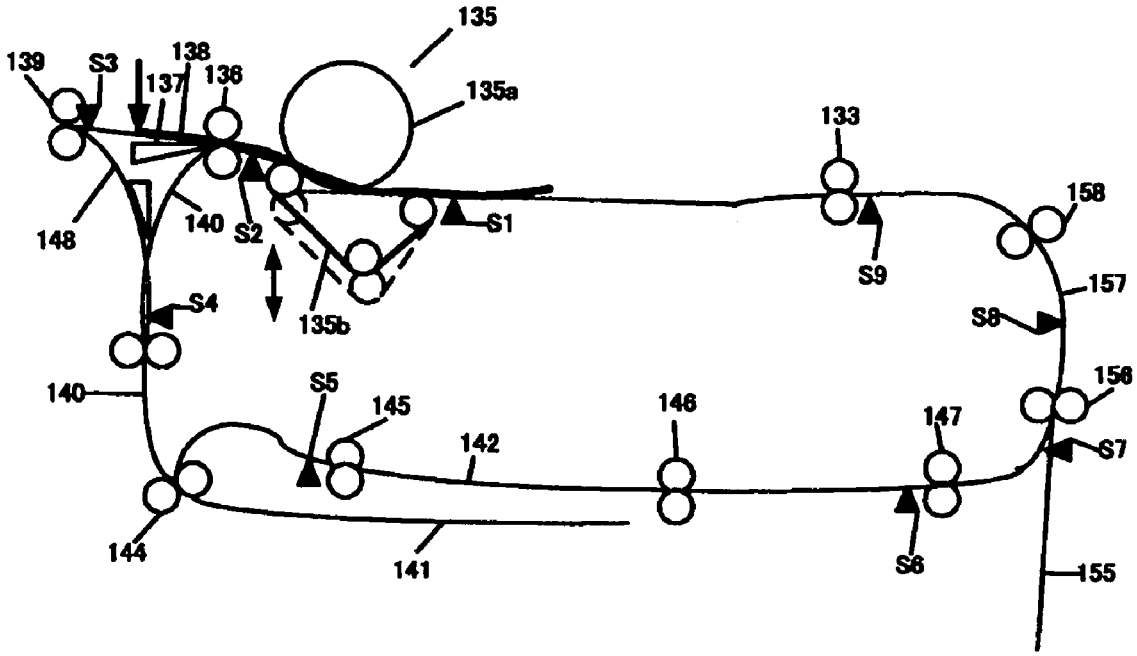
FIG. 8 is an explanatory view showing one example when a paper jam occurs in the image forming apparatus body of the embodiment of the invention.

FIG. 8 shows another example. FIG. 8 shows a state when a sheet jam occurs during conveyance of the sheet to the discharging path 138. In this case, there are sheets in both the pre-fixing sensor S1 and post-fixing sensor S2, it is determined whether the sheets can be conveyed forcibly in the same manner as that shown in FIG. 7. However, in this case, since it is not possible to know where the rear end of the sheet is, and there is a possibility that the sheet can not be sent as shown in FIG. 7(*b*). In this case, it is preferable that it is determined whether the sheet can be sent forcibly using not only the sheet type but also the size (length in the conveyance direction) of the sheet.

[Control Operation when a Paper Jam Occurs]

Figure 9:
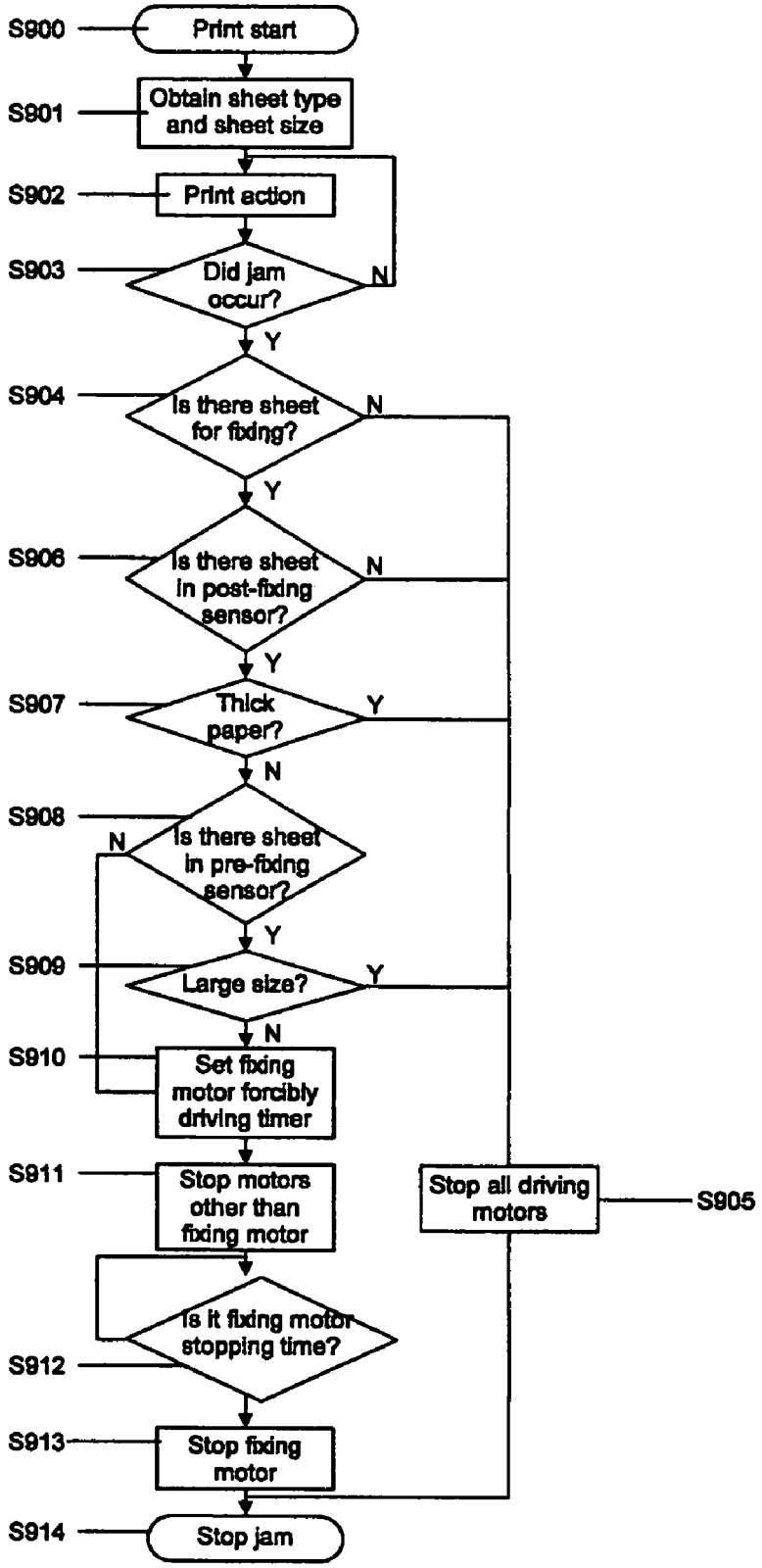
FIG. 9 is a control flowchart of the image forming apparatus of the embodiment of the invention.

FIG. 9 is a control flowchart of the image forming apparatus body of the control when the jam occurs as explained using FIGS. 5 to 8.

In FIG. 9, when copy is carried out in S900, the start key 304 of the operation panel 300 of the image forming apparatus body 100 is pressed, and the printing operation is started. In S901, sheet type and sheet size of a sheet on which copy is carried out are obtained. This includes the obtaining operation of the sheet type by registering the sheet type in the cassette or deck, and since the following fact is further general and thus it is not described in detail, but since the cassette or deck can usually detect the sheet size automatically, it is possible to obtain the size information. In S902, the printing action is started, and it is monitored whether a jam occurs in S903. The plurality of sensors S1 to S9 as the sheet detection means disposed in the sheet conveyance path detect the sheet jam. If there is no paper jam in S903, the printing action is continued in S902, and if the jam occurs, the procedure is advanced to S904, and the procedure is shifted to a jam generation sequence.

In S904, the body controller 202 which controls the sheet conveyance determines whether there is a sheet upstream and downstream of the fixation unit 135. In this embodiment, when it is detected that a jam occurs by detecting the same sheet even if a given reference time elapsed after the outer discharge sensor S3 or the reverse sensor S4 detects the sheet which is being conveyed, it is determined that there are sheets upstream and downstream of the fixation unit 135 in S904. When there is no sheet in the vicinity of the fixation unit 135 in S904, the procedure is advanced to S905, all of the driving motors are stopped, and the crimping belt 135*b* of the fixation unit 135 is separated from the heating roller 135*a*. When there is a sheet near the fixation unit 135 in S904, it is distinguished whether there is a sheet in the post-fixing sensor S2 in S906. If it is determined that there is no sheet in the post-fixing sensor S2 in S906, the procedure is advanced to S905, all of the driving motors are stopped, and the crimping belt 135*b* of the fixation unit 135 is separated from the heating roller 135*a*. If it is determined that there is a sheet in the post-fixing sensor S2 in S906, the procedure is advanced to S907, and the sheet type is distinguished. In S907, if the sheet type obtained in S901 is a thick paper which is thicker than the plain paper, the procedure is advanced to S905, all of the motors are stopped, and the crimping belt 135*b* of the fixation unit 135 is separated from the heating roller 135*a*. With this, the surface of the heating roller 135*a* can be prevented from being damaged by sliding motion between the thick paper and the heating roller 135*a*. If it is determined that the paper is not thick (plain paper) in S907, the procedure is advanced to S908, and it is determined whether there is a sheet in the pre-fixing sensor S1.

If it is determined that there is no sheet in S908, it is determined that the rear end of the sheet is in the nip portion of the fixation unit 135 as shown in FIG. 7(*a*), and it can be determined that the sheet in the fixation unit 135 can forcibly be discharged. Thus, the procedure is advanced to S910, and the forcible discharging sequence shown in FIG. 7(*b*) is carried out by the fixation unit 135.

If it is determined that there is a sheet in the pre-fixing sensor S1 in S908, the amount of sheets existing upstream from the pre-fixing sensor S1 is varied depending upon the sheet size. Thus, if the sheet is forcibly conveyed after fixing, there is a high possibility that the flapper or roller is damaged. Thus, if it is determined that there is a sheet in the pre-fixing sensor S1 in S908, the procedure is advanced to S909, and it is determined whether the sheet size is large or small. If it is determined that the sheet size is large in S909, the procedure is advanced to S905, all of the driving motors are stopped and the crimping belt 502 is separated. With this, the flapper and the roller can be prevented from being damaged as described above, and the damage of the heating roller 135*a* due to slip with respect to the sheet can be avoided. If it is determined that the sheet size is small in S909, the forcibly discharging sequence shown in FIG. 7(*b*) at the fixation unit 135 is carried out.

Here, S910 and subsequent steps constituting a forcibly discharging sequence for forcibly discharging sheets existing in the fixation unit 135. In the forcibly discharging sequence, time during which a fixing motor as the fixing driving means which drives the heating roller 135*a* and the crimping belt 135*b* of the fixation unit 135 is set in S910. Although it is not described in detail, the forcibly driving time is calculated such that a size (length in the conveying direction) from an outlet side nip to the sheet rear end is calculated based on the sheet size and the sheet tip end position such that this time becomes equal to time during which the sheet rear end passes through the nip portion of the heating roller 135*a* and the crimping belt 135*b*, and the driving time is calculated from the conveying speed. In S911, all of the driving motors which are driven other then the fixing motor are stopped. In S912, it is monitored whether the forcibly driving time of the fixing motor is elapsed. If the forcibly driving time is elapsed, the fixing motor is stopped in S913, and the crimping belt 135*b* of the fixation unit 135 is separated from the heating roller 135*a*. By forcibly discharging the sheet, unfused toner image is fused on the sheet, and all of the sheets pass through the fixation unit 500 as shown in FIG. 7(*b*).

According to this embodiment, when a paper jam occurs in the fixation unit 135, it is determined whether this sheet is forcibly discharged from the fixation unit 135 depending upon the sheet type. With this, damage of the fixation unit 135 can be reduced. More specifically, when a paper jam occurs in the fixation unit 135, this sheet is forcibly discharged from the fixation unit 135 by the heating roller 135*a* and the crimping belt 135*b* and after that, it is determined whether the crimping belt 135*b* is separated from the heating roller 135*a* or the sheet is not forcibly discharged and the crimping belt 135*b* is separated from the heating roller 135*a*. Thus, the unfused image can be prevented, the jam processing (jam clearance operation) of a user can be enhanced, and the damage of the fixation unit can be minimized.

Figure 10:
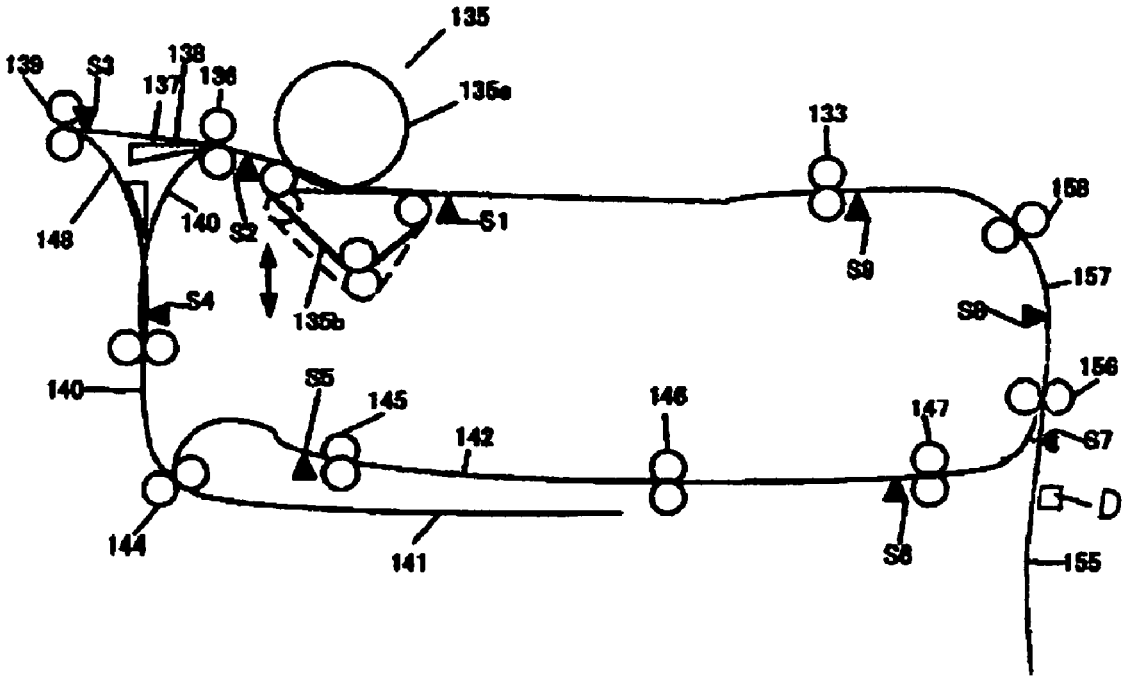
FIG. 10 is a sectional view of an image forming apparatus according to another example of the embodiment of the invention.

In the above-described embodiment, the sheet type is previously registered for each of the sheet type setting means explained using FIG. 4 as the sheet detection means, i.e., the cassette or deck, and the determination is made using the previously registered sheet type, but the present invention is not limited to this. For example, as shown in FIG. 10, the registration roller or the vertical path convey path is provided with a sheet thickness detection sensor D which detects the sheet thickness, and the forcibly discharging sequence when a jam occurs near the fixation unit can be controlled using the sheet thickness information detected by the sheet thickness detection sensor D. According to this structure, in addition to the above-described effect, each of conveyed sheets can be distinguished easily.

In the above-described embodiment, the apparatus includes the fixing driving means which drives the pair of rotation bodies of the fixation unit, but the present invention is not limited to this, and the fixation unit may not includes the driving means. For example, the fixation unit may be driven by receiving transmission of the driving force from another driving means through a driving force transmitting means comprising a gear or the like. In this case, a mechanism capable of transmitting a driving force or releasing the transmission of the driving force may be provided in the driving force transmitting path from the driving means, and this mechanism may be able to drive only the driving means, or driving means capable of normally and reversely rotating may be used and each portion may be driven at the time of driving rotation in one direction, and only the fixation unit may be driven at the time of driving rotation in the other direction.

In the embodiment, only the fixation unit is driven when a sheet is forcibly discharged, and motors other than a motor which drives the fixation unit are stopped. Alternatively, the motor which drives the discharge roller 136 downstream of the fixation unit may be driven at the same time when a sheet is forcibly discharged, and the discharge roller 136 may also be rotated.

In the embodiment, after a paper jam occurs, it is determined whether there is a sheet in the fixation unit using the post-fixing sensor S2, and when there is a sheet in the fixation unit, the sheet is forcibly discharged. Alternatively, it may not be detected whether there is a sheet in the fixation unit, i.e., when a paper jam occurs, operation for forcibly discharging a sheet from the fixation unit may be carried out no matter whether there is a sheet in the fixation unit when the jam occurs. It is determined whether the sheet is forcibly discharged depending upon the sheet type as in the above embodiment.

In the embodiment, if the paper is plain paper, the sheet is forcibly discharged from the fixation unit, and if the paper is thick paper, the sheet is not forcibly discharged from the fixation unit. However, the sheet types of sheets which damage the fixation unit by forcibly discharging the sheet from the fixation unit are different depending upon the apparatus. Thus, it is preferable that a sheet having the strongest rigidity (thickest sheet) which do not damage the fixation unit even if the sheet is forcibly discharged from the fixation unit is found by experiments, and a sheet having stronger rigidity than that sheet is not forcibly discharged from the fixation unit when the jam occurs.

In the embodiment, the heating roller and the crimping belt are used as the pair of rotation bodies against and from which the fixation unit can abut and separate, but the present invention is not limited to this. For example, rotating bodies comprising a heating roller and a pressure roller opposed to the heating roller, or rotating bodies comprising a fixing film which rotates and moves around a fixing sleeve and a pressure roller which is opposed to the fixing film, or other pair of rotation bodies may be used.

In the embodiment, a printer is shown as an example of the image forming apparatus, but the present invention is not limited to this. For example, the image forming apparatus may be other image forming apparatus such as a copying machine, a facsimile machine and the like, a multifunction machine comprising a combination thereof, an image forming apparatus which uses a sheet carrier and which sequentially transfers toner images of various colors in an overlapping manner on the sheet carried by the carrier, or an image forming apparatus which uses an intermediate transfer members and which sequentially transfers toner images of various color on the intermediate transfer member in an overlapping manner, and the toner images carried by the intermediate transfer member are collectively transferred on the sheet. If the present invention is applied to such image forming apparatus, the same effect can be obtained.

According to the embodiment, when a sheet jam occurs in the fixation unit, it is determined whether the sheet should be forcibly discharged from the fixation unit depending upon the sheet type. With this, damage of the fixation unit can be reduced.

What is claimed is:

1. An image forming apparatus comprising:

an image forming portion configured to form a toner image on a sheet;

a fixation device configured to fix, on the sheet, the toner image formed by the image forming portion;

a jam detecting portion configured to detect whether a jam of the sheet occurs;

a sheet-type distinguishing portion configured to distinguish a type of the sheet; and a controller which controls whether the fixation device should be driven such as to convey the sheet in the fixation device depending upon a sheet type of the sheet distinguished by the sheet-type distinguishing portion when the jam detecting portion detects that a jam of the sheet occurs.

2. The image forming apparatus according to claim 1, further comprising sheet detection means for detecting whether there is a sheet in the fixation device when the jam detecting portion detects that the sheet jam occurs, wherein when the sheet jam occurs and the sheet detection means detects that there is a sheet in the fixation device, the controller controls whether the fixation device should be driven such as to discharge the sheet from the fixation device depending upon the sheet type of the sheet distinguished by the sheet-type distinguishing portion.

3. The image forming apparatus according to claim 1, wherein the fixation device includes a pair of rotation bodies which sandwich a sheet, the rotation bodies convey the sheet and fuse a toner image on the sheet, when a sheet jam occurs, the controller controls whether the rotation bodies should be separated from each other after the sheet is conveyed by the rotation bodies, or the rotation bodies should be separated without conveying the sheet in the fixation device, based on a sheet type distinguished by the sheet-type distinguishing portion.

4. The image forming apparatus according to claim 1, wherein the controller controls the fixation device such that a sheet in the fixation device is conveyed when the sheet in the fixation device is distinguished as plain paper by the sheet-type distinguishing portion, and the sheet in the fixation device is not conveyed when the sheet in the fixation device is distinguished as thick paper which is thicker than the plain paper by the sheet-type distinguishing portion.

5. The image forming apparatus according to claim 1, wherein the controller controls the fixation device such that a sheet in the fixation device is conveyed when the sheet in the fixation device is distinguished as shorter sheet than a predetermined length, and the sheet in the fixation device is not conveyed when the sheet in the fixation device is distinguished as longer sheet than the predetermined length.

6. The image forming apparatus according to claim 1, further comprising an operation panel which is operated by a user to set a sheet type, wherein a sheet-type distinguishing portion distinguishes the sheet type based on a setting by a user using the operation panel.

7. The image forming apparatus according to claim 1, a sheet-type distinguishing portion is a sheet thickness detection sensor which detects rigidity of sheet by a sheet thickness.

* * * * *

UNITED STATES PATENT AND TRADEMARK OFFICE

CERTIFICATE OF CORRECTION

PATENT NO. : 7,391,980 B2
APPLICATION NO. : 11/114166
DATED : June 24, 2008
INVENTOR(S) : Sekiguchi et al.

It is certified that error appears in the above-identified patent and that said Letters Patent is hereby corrected as shown below:

ON THE TITLE PAGE:
At Item (56), References Cited, Foreign Patent Documents, "JP 3-28373 3/2002" should read --JP 328373 3/2002--, and "JP 07181828 A * 7/1995" should be deleted.

COLUMN 1:
Line 65, "FIG. 3" should read --FIGS. 3(a) and 3(b)--.

COLUMN 2:
Line 1, "FIG. 4" should read --FIGS. 4(a) and 4(b)--.
Line 10, "FIG. 7" should read --FIGS. 7(a) and 7(b)--.
Line 58, "leaser" should read --laser--.

COLUMN 3:
Line 3, "leaser beam" should read --laser beam--.
Line 13, "132one" should read --132 one--.

COLUMN 4:
Line 37, "one sides" should read --one side--.
Line 52, "a operation" should read --an operation--.

COLUMN 5:
Line 1, "there a" should read --there is a--.
Line 38, "FIG. 3" should read --FIGS. 3(a) and 3(b)--.
Line 47, "keypad 302" should read --keypad--.
Line 52, "a type of sheets" should read --a type of sheet--.

COLUMN 6:
Line 34, "FIG. 4" should read --FIGS. 4(a) and 4(b)--.
Line 52, "a type of sheets" should read --a type of sheet--.

COLUMN 7:
Line 37, "accordance" should read --accordance with--.

UNITED STATES PATENT AND TRADEMARK OFFICE

CERTIFICATE OF CORRECTION

PATENT NO. : 7,391,980 B2
APPLICATION NO. : 11/114166
DATED : June 24, 2008
INVENTOR(S) : Sekiguchi et al.

It is certified that error appears in the above-identified patent and that said Letters Patent is hereby corrected as shown below:

COLUMN 8:
Line 11, “should forcibly” should read --should be forcibly--.

COLUMN 9:
Line 15, “FIG. 7” should read --FIGS. 7(a) and 7(b)--.
Line 31, “sheets, this” should read --sheet. This--.
Line 34, “FIG. 4,” should read --FIGS. 4(a) and 4(b),--.
Line 47, “S2, it is” should read --S2. It is--.
Line 49, “FIG. 7.” should read --FIGS 7(a) and 7(b).--.
Line 51, “and there” should read --there--.

COLUMN 10:
Line 65, “constituting” should read --constitutes--.

COLUMN 11:
Line 12, “other then” should read --other than--.
Line 51, “includes” should read --include--.

COLUMN 12:
Line 23, “do not” should read --does not--.
Line 47, “bers” should read --ber--.

Signed and Sealed this

Second Day of December, 2008

JON W. DUDAS
*Director of the United States Patent and Trademark Office*